US011808265B2

(12) United States Patent
Cornwell

(10) Patent No.: US 11,808,265 B2
(45) Date of Patent: Nov. 7, 2023

(54) ENERGY-CONSERVING FLUID PUMP

(71) Applicant: Gary Raymond Cornwell, Melbourne, FL (US)

(72) Inventor: Gary Raymond Cornwell, Melbourne, FL (US)

(73) Assignee: KINETIC TECHNOLOGY SYSTEMS, LLC, Duxbury, MA (US)

( * ) Notice: Subject to any disclaimer, the term of this patent is extended or adjusted under 35 U.S.C. 154(b) by 352 days.

(21) Appl. No.: 17/113,871

(22) Filed: Dec. 7, 2020

(65) Prior Publication Data

US 2021/0172441 A1 Jun. 10, 2021

Related U.S. Application Data

(60) Provisional application No. 62/944,702, filed on Dec. 6, 2019.

(51) Int. Cl.

| | |
|---|---|
| ***F04D 13/02*** | (2006.01) |
| ***F04D 13/06*** | (2006.01) |
| ***F04D 29/44*** | (2006.01) |

(52) U.S. Cl.
CPC ..... *F04D 13/024* (2013.01); *F04D 13/06* (2013.01); *F04D 29/448* (2013.01)

(58) Field of Classification Search
CPC ..... F04D 13/024; F04D 13/06; F04D 29/448; F04D 29/4293; F04D 13/0646
See application file for complete search history.

(56) References Cited

U.S. PATENT DOCUMENTS

| | | | | |
|---|---|---|---|---|
| 4,251,184 | A | 2/1981 | Budrys | |
| 6,171,078 | B1 | 1/2001 | Schoeb | |
| 6,345,961 | B1 * | 2/2002 | Oklejas, Jr. | F04D 29/448 417/407 |
| 8,613,605 | B2 | 12/2013 | Hammar et al. | |
| 2006/0198731 | A1 | 9/2006 | Shaw et al. | |
| 2006/0245959 | A1 * | 11/2006 | LaRose | A61M 60/824 417/423.5 |
| 2010/0284812 | A1 | 11/2010 | Zahdeh | |
| 2013/0209292 | A1 * | 8/2013 | Baykut | F04D 29/048 415/73 |
| 2018/0283399 | A1 * | 10/2018 | Gu | F04D 29/588 |
| 2020/0392960 | A1 * | 12/2020 | Stuiver | F04D 3/00 |

* cited by examiner

*Primary Examiner* — Dominick L Plakkoottam
(74) *Attorney, Agent, or Firm* — Carlson, Gaskey & Olds, P.C

(57) ABSTRACT

An energy-conserving fluid pump is an apparatus used to transport low viscosity fluids like water and fuel without experiencing cavitation, recirculation, nor motor locking while also conserving energy. The apparatus includes a fluid diffuser, a fluid densifier, a convergent housing, and a strut assembly. The fluid diffuser improves the efficiency of the apparatus by expanding the fluid inflow and maintaining a fluid pressure buildup. The fluid densifier shears the incoming fluid flow from the fluid diffuser and increases the fluid outflow pressure. The convergent housing encloses the fluid diffuser and the fluid densifier while facilitating the outflow of the pressurized fluid without the loss of fluid pressure nor cavitation. In addition, the convergent housing facilitates the transfer of torque to the fluid diffuser for the operation of the apparatus. The strut assembly keeps the fluid densifier stationary while enabling the rotation of the convergent housing and/or the fluid diffuser.

12 Claims, 17 Drawing Sheets

ENERGY-CONSERVING FLUID PUMP

The current application claims a priority to the U.S. Provisional Patent application Ser. No. 62/944,702 filed on Dec. 6, 2019. The current application is filed on Dec. 7, 2020 while Dec. 6, 2020 was on a weekend.

FIELD OF THE INVENTION

The present invention relates generally to centrifugal fluid pumps. More specifically, the present invention is a pump designed for energy conservation and reduction of cavitation by driving the pump with the housing together and by utilizing size-reducing channels.

BACKGROUND OF THE INVENTION

Typical pumps on the market today fall into two categories: centrifugal pumps and positive displacement pumps. Each type of pump classification has clearly different characteristics that set the two apart. In contrast, the present invention is unique in that it incorporates both. The present invention has unique characteristics that set it apart from all other fluid pumps by having the pump and pump housing rotate on the same axle. Currently, there is nothing like the present invention on the market today. The faster the present invention rotates, the higher the Gallons Per Minute (GPM) produced as well as a higher flow pressure. The present invention can run in a range of 1000 to 100,000 RPMs with no cavitation. In comparison, typical centrifugal pumps are limited to about 3500 RPMs due to cavitation issues.

To compare the present invention to typical pumps, the assumption is that all pumps have no pressure relief valve to compare each pump at the same comparative level. In addition, the pump is turned on and left on:

- When the fluid is stopped in a running typical centrifugal pump, the pump will continue to run, churning up the fluid within the housing/volute, and allowing cavitation and recirculation to occur. Also, there will be no fluid flow and no pressure gain with increased RPMs. This condition is caused due to the pump/impeller rotating independent of the housing where there are gaps around the impeller, thus allowing fluid to slosh around. Results: high load condition, high energy loss and no work done.
- With hydraulic positive displacement pumps (gear, rotor, diaphragm, or piston pumps) fluid is pushed through the pump by brute force from the driving motor. If flow is stopped, the driving motor will lock and stop rotating. This phenomenon happens due to the physics of liquid not being able to be compressed. Results: high energy loss, ruined motor, no work done.
- If the fluid in the pump of the present invention is stopped, no hydraulic lock occurs and the pump will stay rotating with no flow; however, the pressure will continue to increase with increased RPMs. The energy effects of a no flow condition using the pump of the present invention is essentially rotating the mass of the pump and fluid within. There will be a no load, no cavitation, no recirculation of fluid, and low energy condition. The same condition occurs when covering the suction hose on a vacuum cleaner, the RPMs increase and current decreases, thus eliminating the load which is the moving air. With an increase in RPMs, there will be an increase in Counter Electro Motive Force (CEMF), creating an increased electrical resistance, thus decreasing current flow/lower cost.

No other fluid pump on the market today performs like the present invention. Further, the pump of the present invention size-decreasing channels that increase pressure as the fluid moves through the channels. All these features make the pump of the present invention the best pump for water desalinization as well as for other applications. Additional benefits and features of the present invention are further discussed in the following sections.

SUMMARY OF THE INVENTION

The present invention provides an energy-conserving fluid pump including a convergent housing, a fluid diffuser, and a fluid densifier. The components are connected and locked together to rotate together as one sealed unit, except for the fluid densifier. The flowing fluid is constantly building pressure as the fluid moves through the energy-conserving fluid pump, eliminating the possibility of cavitation within the convergent housing. Once the fluid leaves the fluid diffuser, the flowing fluid is immediately sheared by the stationary fluid densifier, sent downward to the center of rotation of the convergent housing, and then out of the convergent housing without rotating itself. The fluid densifier multiplies the pressure of the fluid traveling through the fluid densifier until the fluid is redirected to a housing outlet.

DETAILED DESCRIPTION OF THE INVENTION

Figure 1:
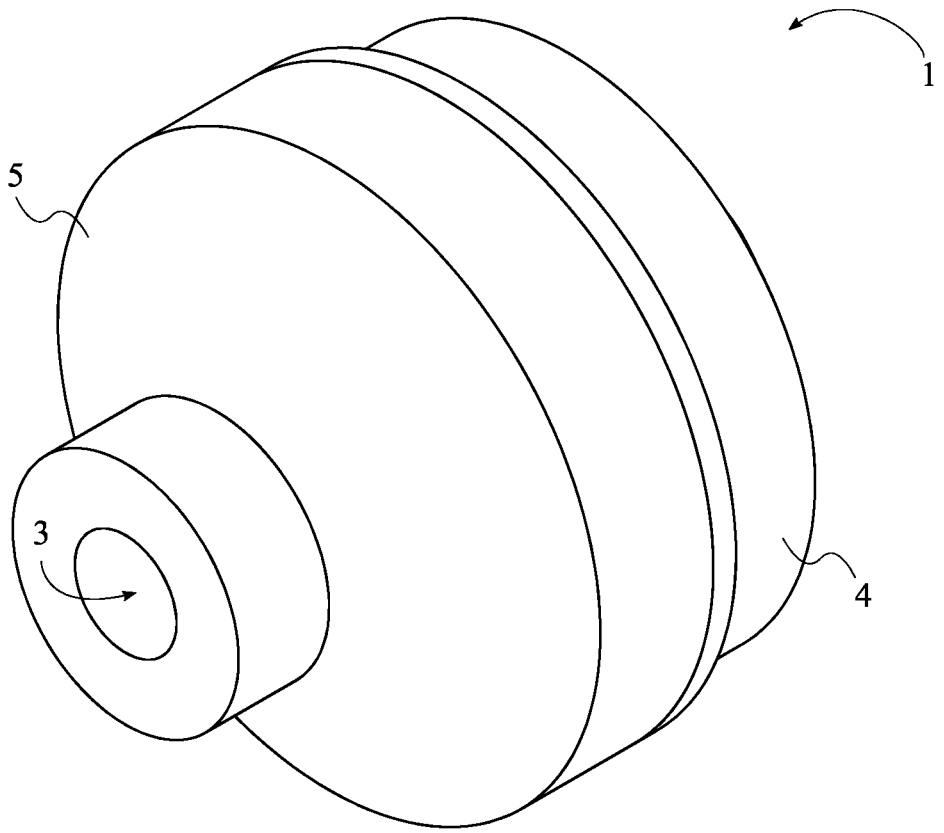
FIG. 1 is a top front perspective view showing the energy-conserving fluid pump.
Figure 2:
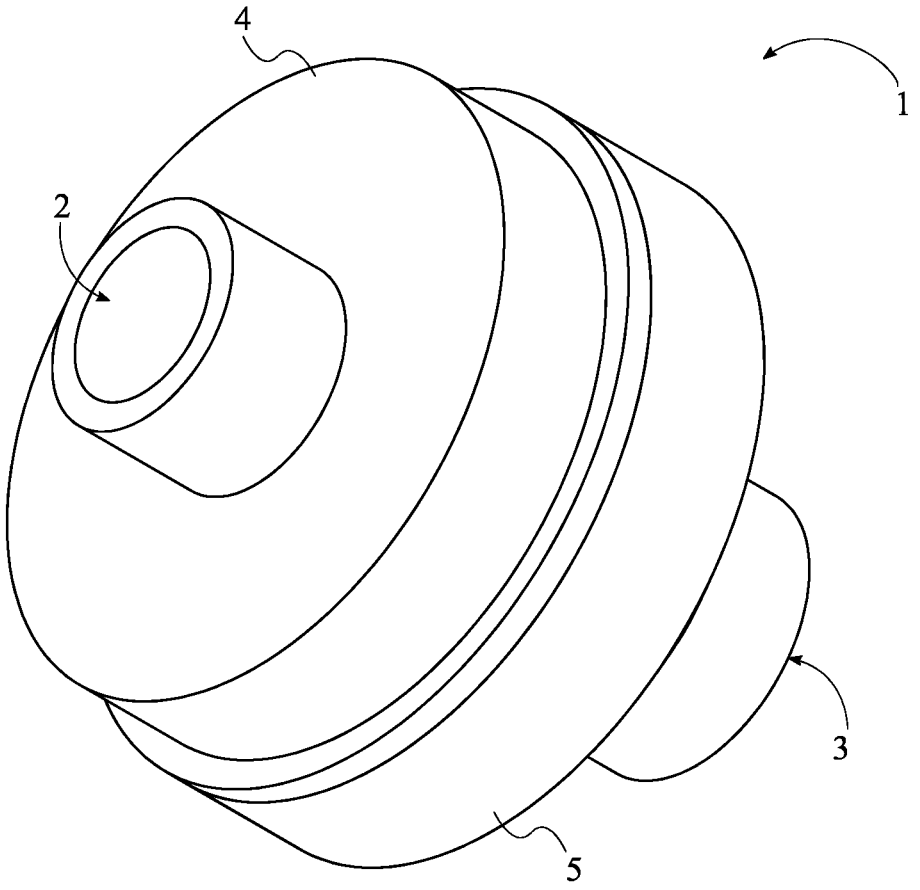
FIG. 2 is a bottom rear perspective view showing the energy-conserving fluid pump.

All illustrations of the drawings are for the purpose of describing selected versions of the present invention and are not intended to limit the scope of the present invention.

The present invention is an energy-conserving fluid pump which prevents cavitation, recirculation, and motor locking while conserving energy. The present invention can transport low viscosity fluids like water and fuel, and the primary application of the present invention is water desalinization and propulsion where high pressure along with high volume and reduced energy usage are crucial. As can be seen in FIG. 1 through 4, the present invention may comprise a fluid diffuser 7, a fluid densifier 13, and a convergent housing 1. The fluid diffuser 7 improves the efficiency of the present invention by expanding the fluid inflow. The fluid densifier 13 shears the fluid flow from the fluid diffuser 7 and increases the fluid outflow pressure. The convergent housing 1 encloses the fluid diffuser 7 and the fluid densifier 13 while facilitating the outflow of the pressurized fluid without the loss of fluid pressure nor cavitation. In addition, the convergent housing 1 facilitates the transfer of torque to the fluid diffuser 7 for the operation of the present invention.

The general configuration of the aforementioned components allows the present invention to transport low viscosity fluids while preserving energy, preventing cavitation, and maintaining a high-pressure output. As can be seen in FIG. 5 through 8, the fluid densifier 13 comprises a densifier body 14, a plurality of densifier inlets 17, a densifier outlet 18, and a plurality of spiraling channels 19. Also, the densifier body 14 comprises a first densifier face 15 and a second densifier face 16. The convergent housing 1 comprises a housing inlet 2 and a housing outlet 3 to enable the fluid flow through the convergent housing 1. The fluid diffuser 7 and fluid densifier 13 are rotatably mounted to each other so that the fluid diffuser 7 can rotate. However, the fluid densifier 13 does not rotate with the fluid diffuser 7. In addition, the fluid diffuser 7 and the fluid densifier 13 are positioned within the convergent housing 1 so that the fluid diffuser 7 and the fluid densifier 13 are sealed within. Thus, no sloshing happens within the convergent housing 1 during or after operation.

Figure 3:
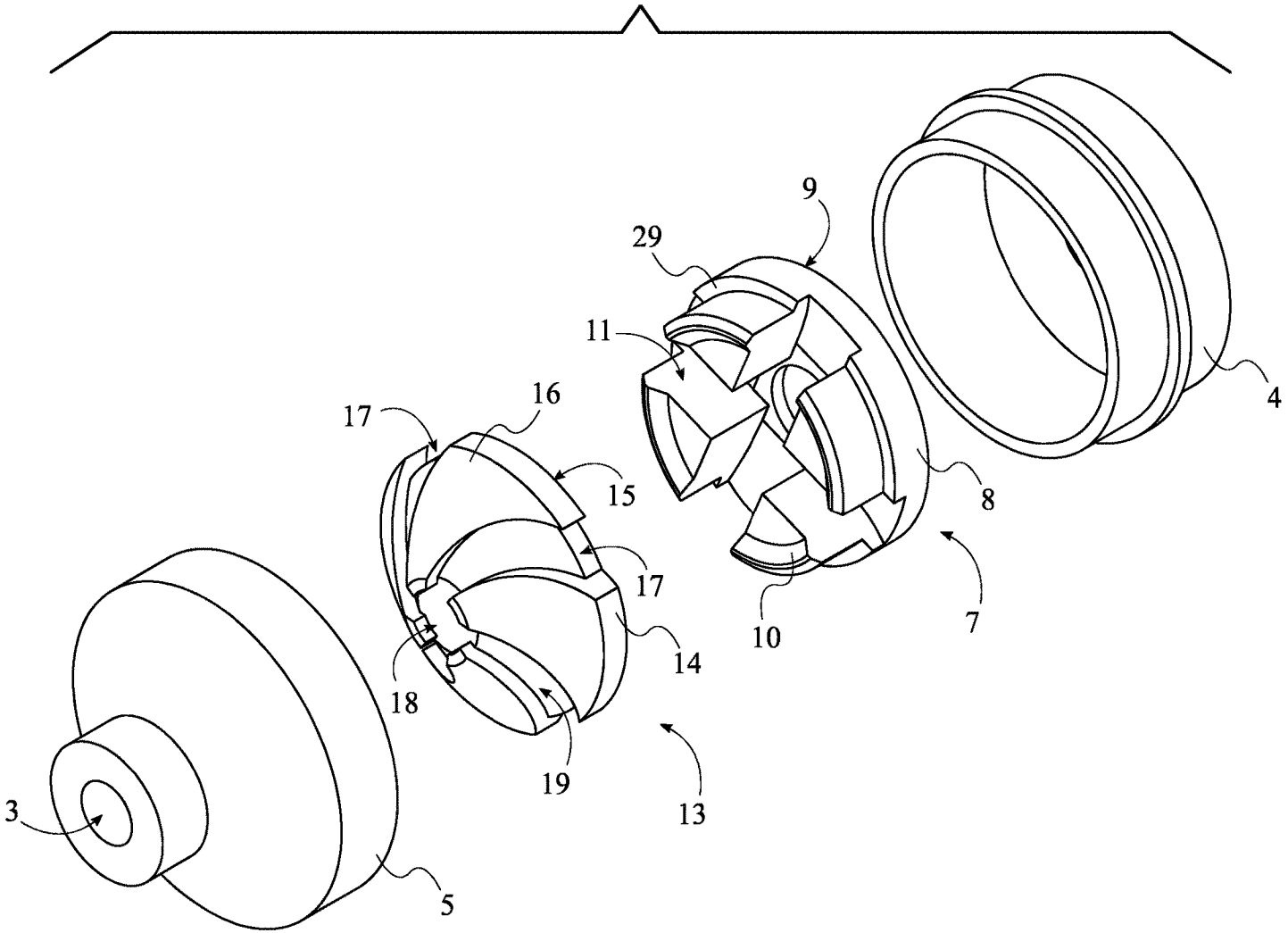
FIG. 3 is a top front-exploded perspective view showing the energy-conserving fluid pump.
Figure 4:
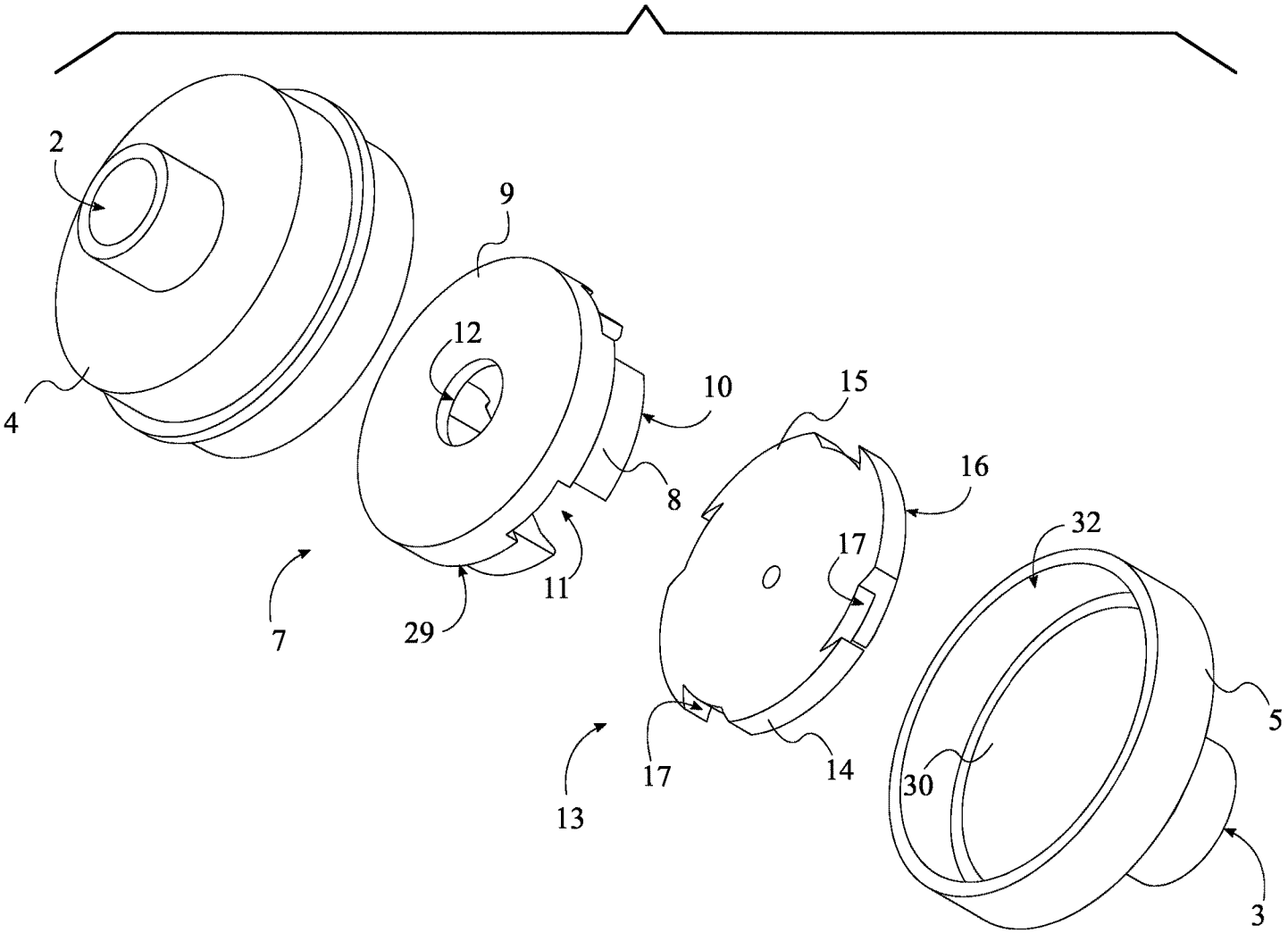
FIG. 4 is a bottom rear-exploded perspective view showing the energy-conserving fluid pump.
Figure 5:
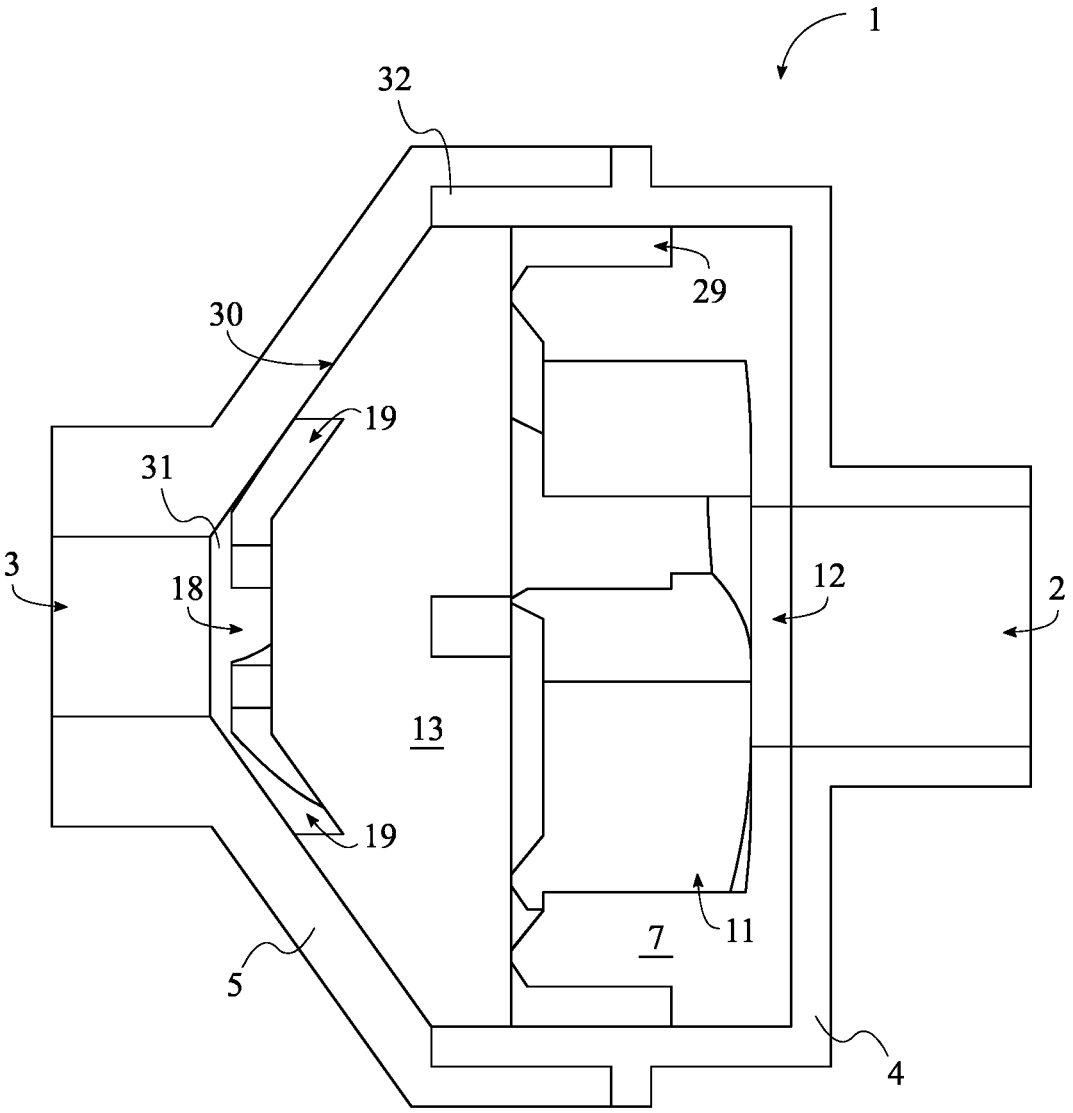
FIG. 5 is a schematic view showing the fluid diffuser and the fluid densifier withing the energy-conserving fluid pump.
Figure 6:
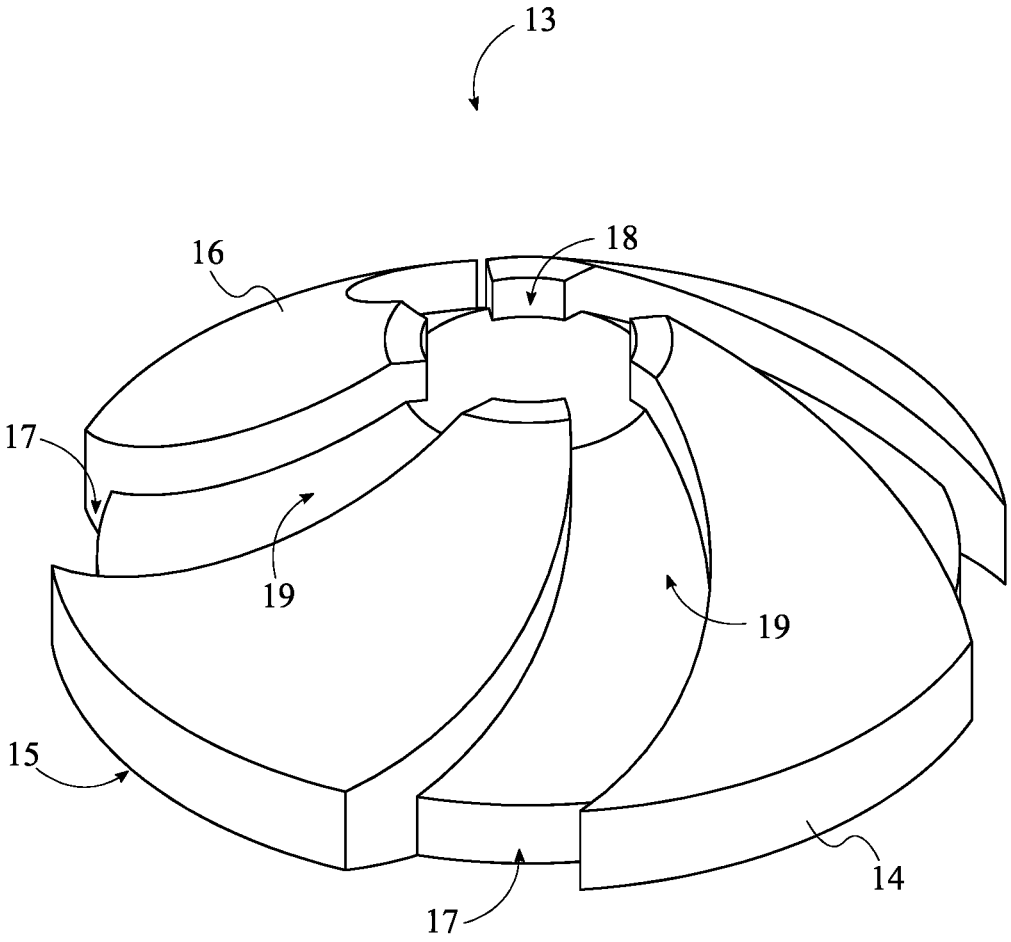
FIG. 6 is a top front perspective view showing the fluid densifier.
Figure 7:
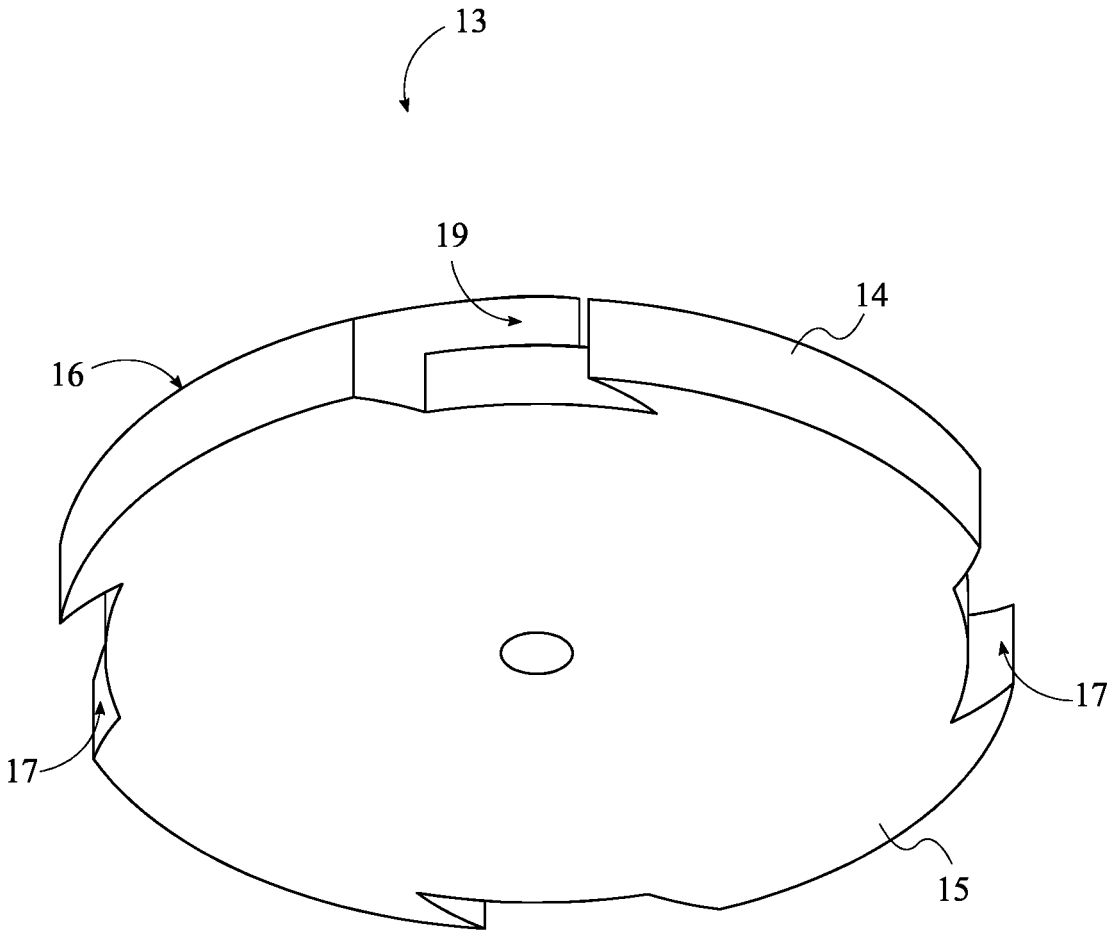
FIG. 7 is a bottom rear perspective view showing the fluid densifier.
Figure 8:
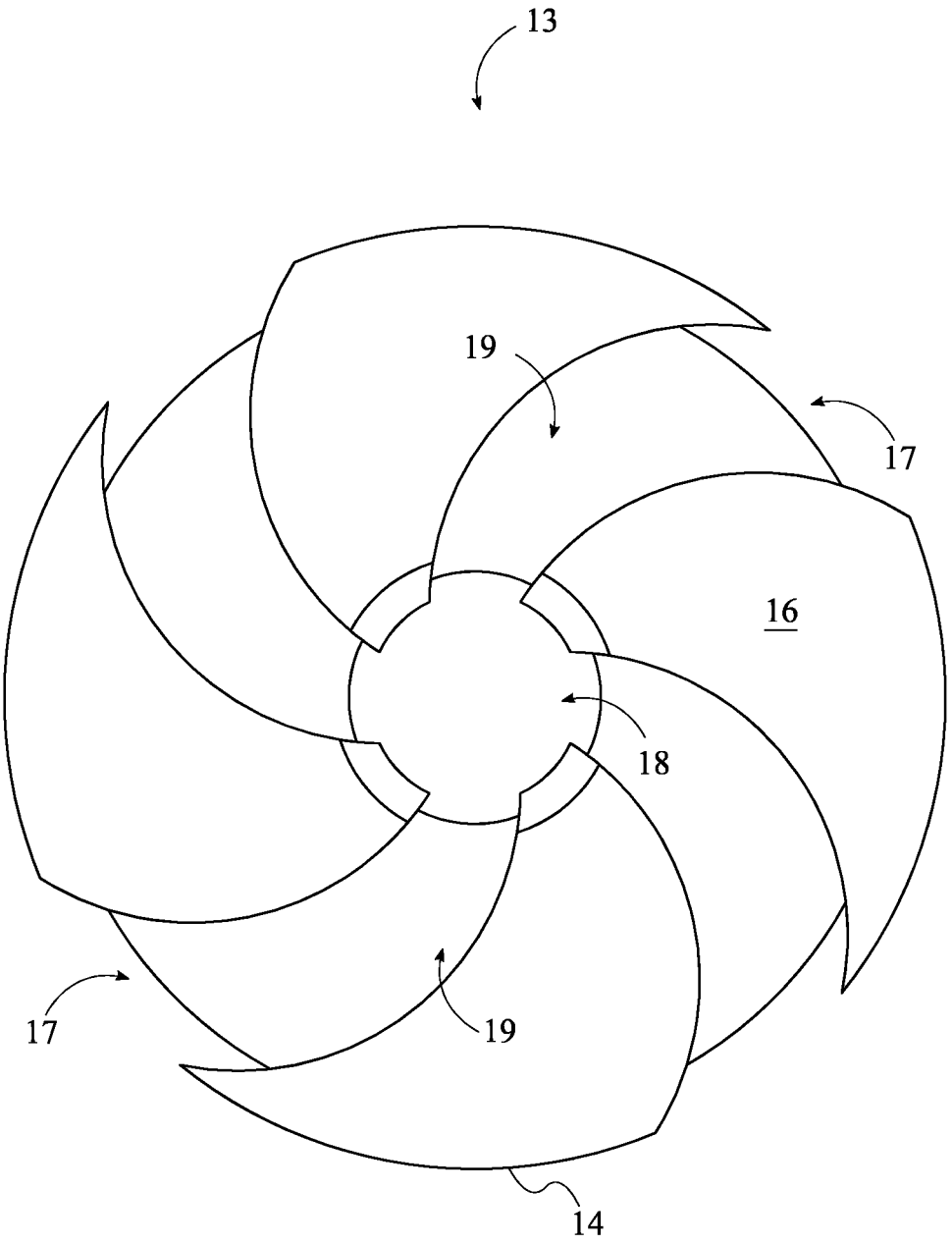
FIG. 8 is a top view showing the fluid densifier.

As can be seen in FIG. 6 through 8, the first densifier face 15 and the second densifier face 16 are positioned opposite to each other about the densifier body 14, forming the disc shape of the densifier body 14. The plurality of densifier inlets 17 traverse from the first densifier face 15, through the densifier body 14, and to the second densifier face 16 to enable the fluid flow through the densifier body 14. The plurality of densifier inlets 17 is peripherally distributed about the densifier body 14 to guide the flowing fluid from the periphery of the densifier body 14 to the center. The densifier outlet 18 and each of the plurality of spiraling channels 19 traverse from the second densifier face 16 into the densifier body 14 to enable the shearing of the flowing fluid. The plurality of spiraling channels 19 is radially positioned about the densifier outlet 18 to shear the fluid flowing through the densifier body 14. Further, the amount of plurality of spiraling channels 19 matches the amount of plurality of densifier inlets 17. As can be seen in FIG. 3 through 5, the housing inlet 2 is in fluid communication with the plurality of densifier inlets 17 through the fluid diffuser 7 so the flowing fluid is expanded before reaching the fluid densifier 13. As the fluid flows from the rotating fluid diffuser 7 to the stationary fluid densifier 13, the fluid shear takes place and increases as fluid flow decreases. At the same time, fluid pressure and RPMs are increasing without adding load to the system, thus maintaining energy conservation. Each of the plurality of densifier inlets 17 is in fluid communication with the densifier outlet 18 through a corresponding spiraling channel from the plurality of spiraling channels 19 so the sheared fluid can exit the densifier body 14. Further, the densifier outlet 18 is in fluid communication with the housing outlet 3 so the pressurized fluid can exit the convergent housing 1. The densifier outlet 18 is slightly smaller than the plurality of spiraling channels 19 in volume to maintain a high pressure while vectoring the fluid back to the center of the convergent housing 1 and out into an external plumbing system.

Figure 16:
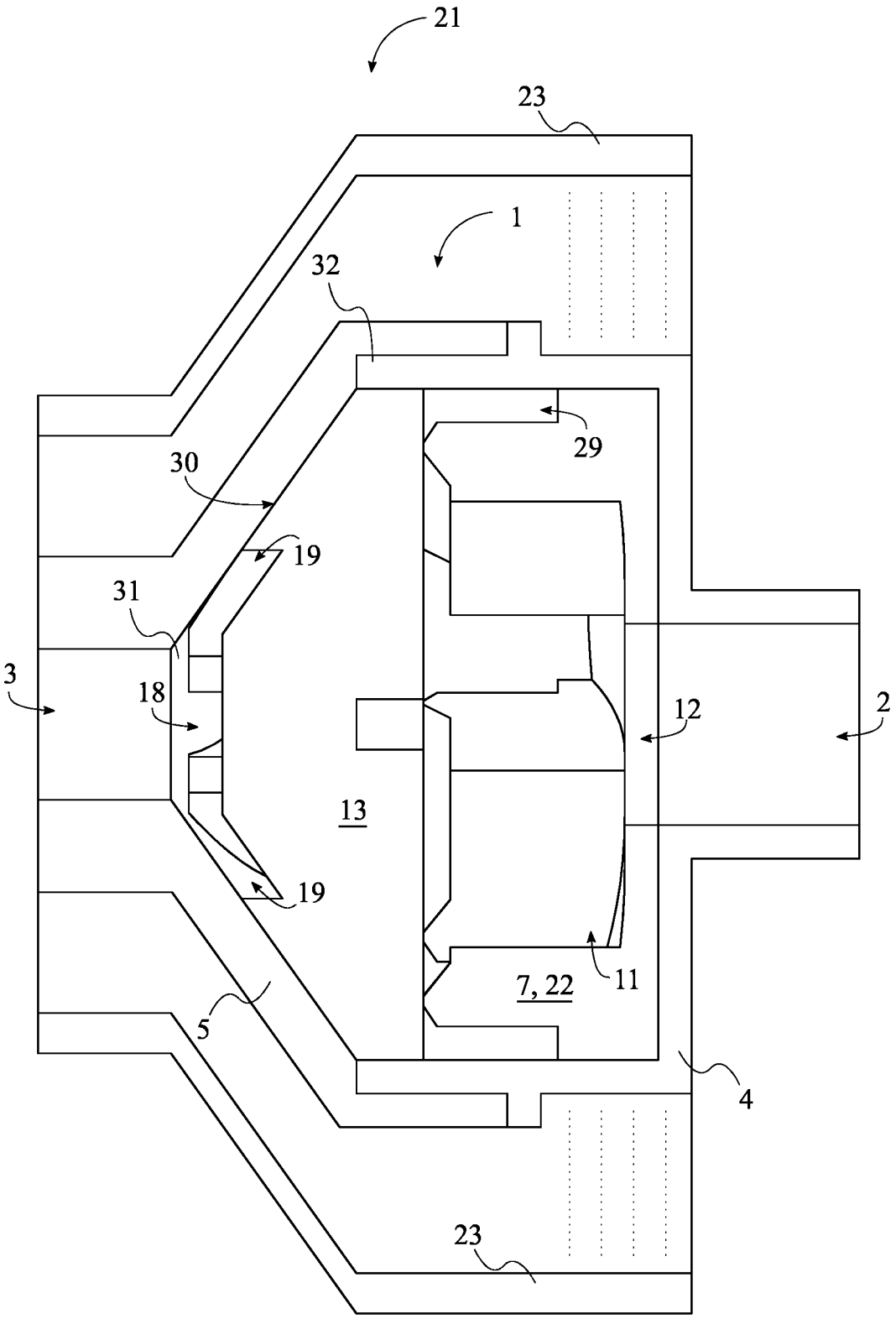
FIG. 16 is a schematic view showing the energy-conserving fluid pump with a magnetic coupling.

To prevent motor locking or similar operational issues present in traditional pumps, the present invention utilizes different methods to drive the rotation of the fluid diffuser 7. The convergent housing 1 and/or the fluid diffuser 7 can be driven by external means or be an integral part of the driving means. In some embodiments, the present invention may further comprise a magnetic coupling 21 which enables the fluid diffuser 7 to be driven by an external electromagnetic motor. As can be seen in FIG. 16, the magnetic coupling 21 comprises a coupling rotor 22 and a coupling stator 23. As previously discussed, the fluid diffuser 7 is rotatably mounted within the convergent housing 1 and the fluid densifier 13 is stationarily mounted within the convergent housing 1. In this embodiment, the fluid diffuser 7 is coupling rotor 22. On the other hand, the coupling stator 23 is externally mounted onto the convergent housing 1 and the coupling stator 23 is also positioned about the fluid diffuser 7 to connect the present invention to the external electromagnetic motor. Further, the coupling stator 23 is operatively coupled to the coupling rotor 22, wherein the coupling stator 23 is used to magnetically rotate the coupling rotor 22. For example, the magnetic coupling 21 can utilize multiple magnetic devices, such as magnetic bushings, externally connected to the fluid diffuser 7 or the convergent housing 1.

Figure 12:
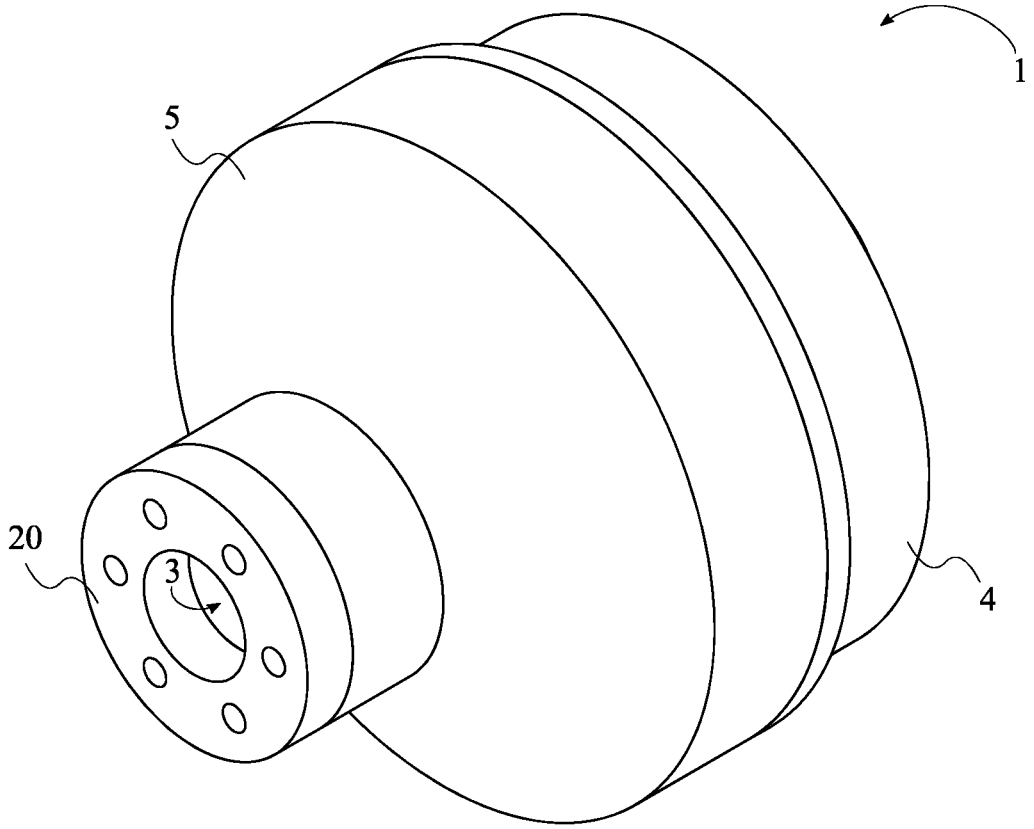
FIG. 12 is a top front perspective view showing the energy-conserving fluid pump with a pump drive coupling.
Figure 13:
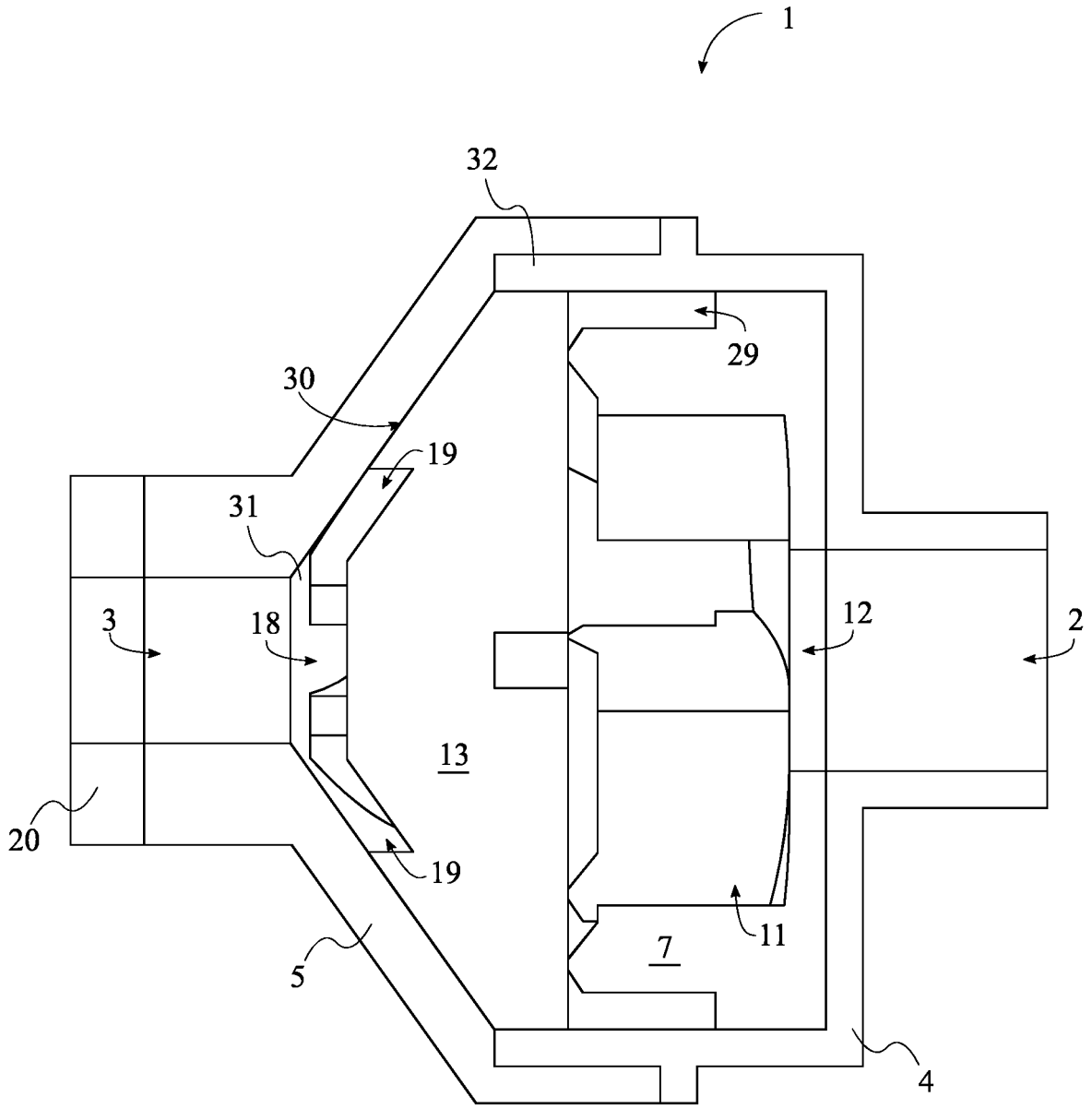
FIG. 13 is a schematic view showing the energy-conserving fluid pump with the pump drive coupling.

In other embodiments, the present invention can utilize external mechanical means to drive the fluid diffuser 7. The external mechanical means can include an external motor or an electric or petroleum fuel engine. As can be seen in FIGS. 12 and 13, the present invention may further comprise a pump drive coupling 20 to rotate the fluid diffuser 7 to the desired RPM. The pump drive coupling 20 can be a cogged belt or gears. Unlike the embodiment with the magnetic coupling 21, the fluid diffuser 7 is stationarily mounted within the convergent housing 1 so the convergent housing 1 rotates along with the fluid diffuser 7. On the other hand, the fluid densifier 13 is rotatably mounted within the convergent housing 1 so the fluid densifier 13 does not rotate along with the convergent housing 1. The pump drive coupling 20 is positioned about the housing outlet 3. In addition, the pump drive coupling 20 is torsionally and externally connected to the convergent housing 1 to transmit the torque from an external source to the convergent housing 1. Thus, as the convergent housing 1 rotates, the fluid diffuser 7 rotates but the fluid densifier 13 stays stationary.

Figure 14:
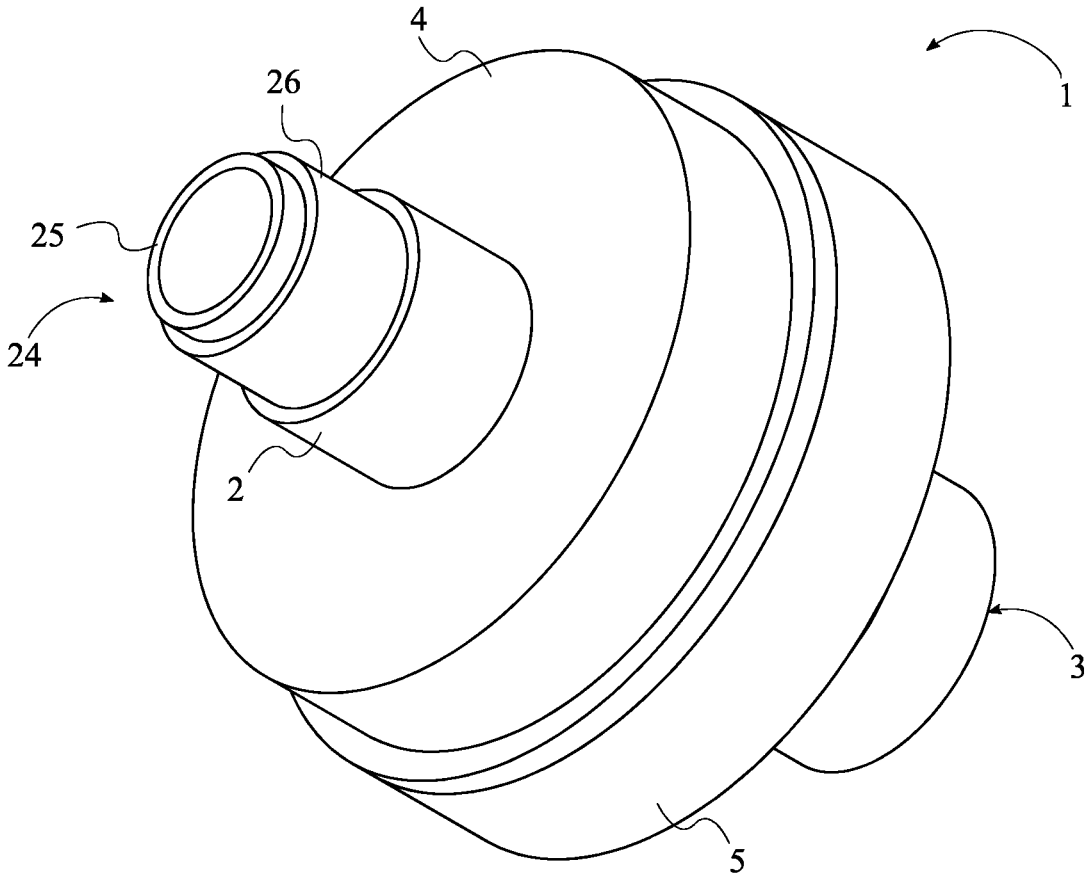
FIG. 14 is a bottom rear perspective view showing the energy-conserving fluid pump connected to an electric motor.
Figure 15:
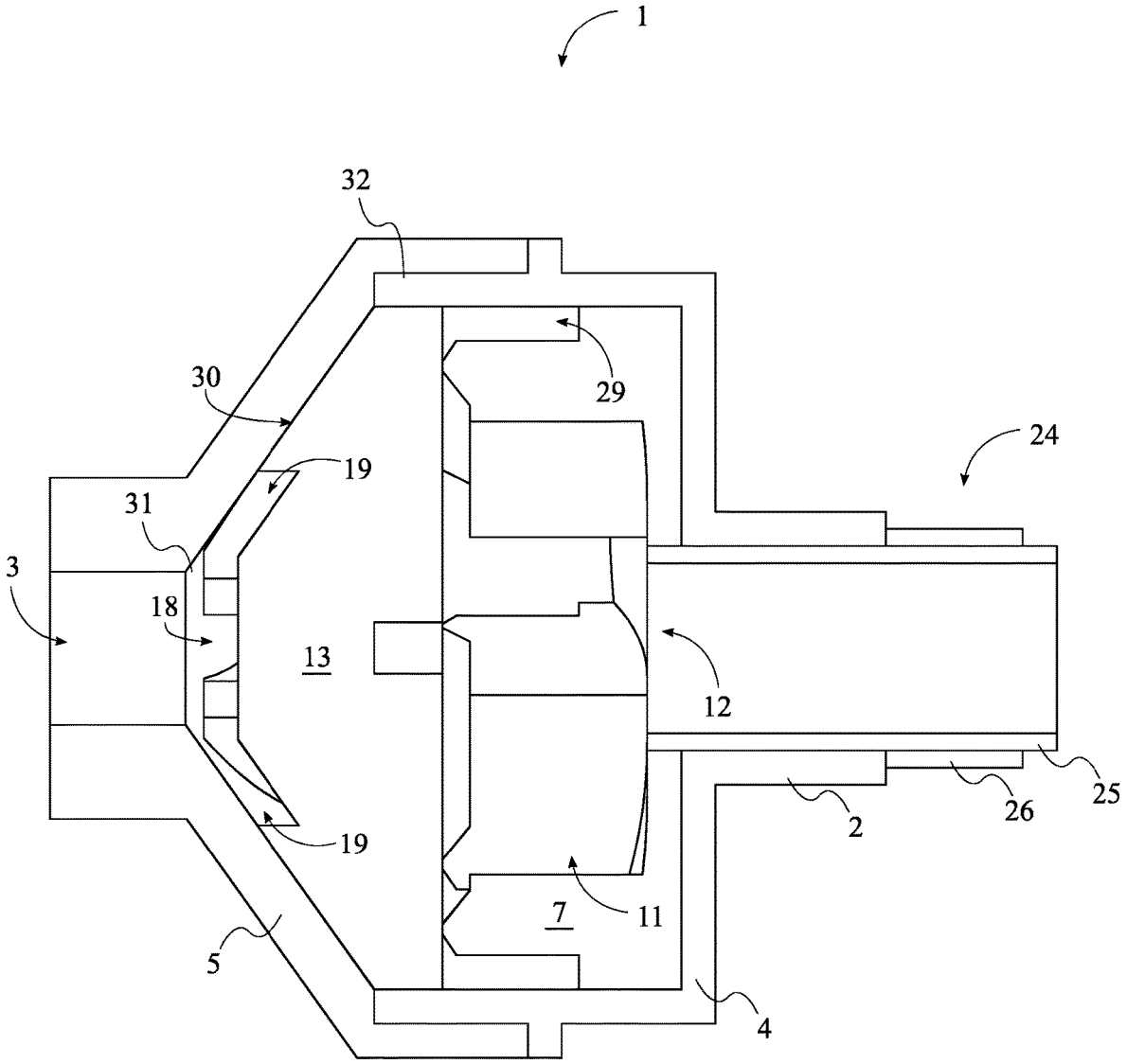
FIG. 15 is a schematic view showing the energy-conserving fluid pump connected to the electric motor.

Furthermore, the present invention can utilize integrated mechanical means to rotate the fluid diffuser 7 within the convergent housing 1. As can be seen in FIGS. 14 and 15, the present invention may further comprise an electric motor 24. The electric motor 24 comprises a motor rotor 25 and a motor stator 26. Like the embodiment with the magnetic coupling 21, the fluid diffuser 7 is rotatably mounted within the convergent housing 1 and the fluid densifier 13 is stationarily mounted within the convergent housing 1. The electric motor 24 is also positioned within the convergent housing 1 so the electric motor 24 can be connected to the fluid diffuser 7. The motor stator 26 is stationarily connected to the convergent housing 1 and the motor rotor 25 is torsionally connected to the fluid diffuser 7. Thus, when the electric motor 24 is engaged, the motor rotor 25 will rotate about the motor stator 26, causing the fluid diffuser 7 to rotate to the desired RPM. In other embodiments, the present invention can utilize other drive means to rotate the convergent housing 1 and/or the fluid diffuser 7 to the desired RPM.

Figure 9:
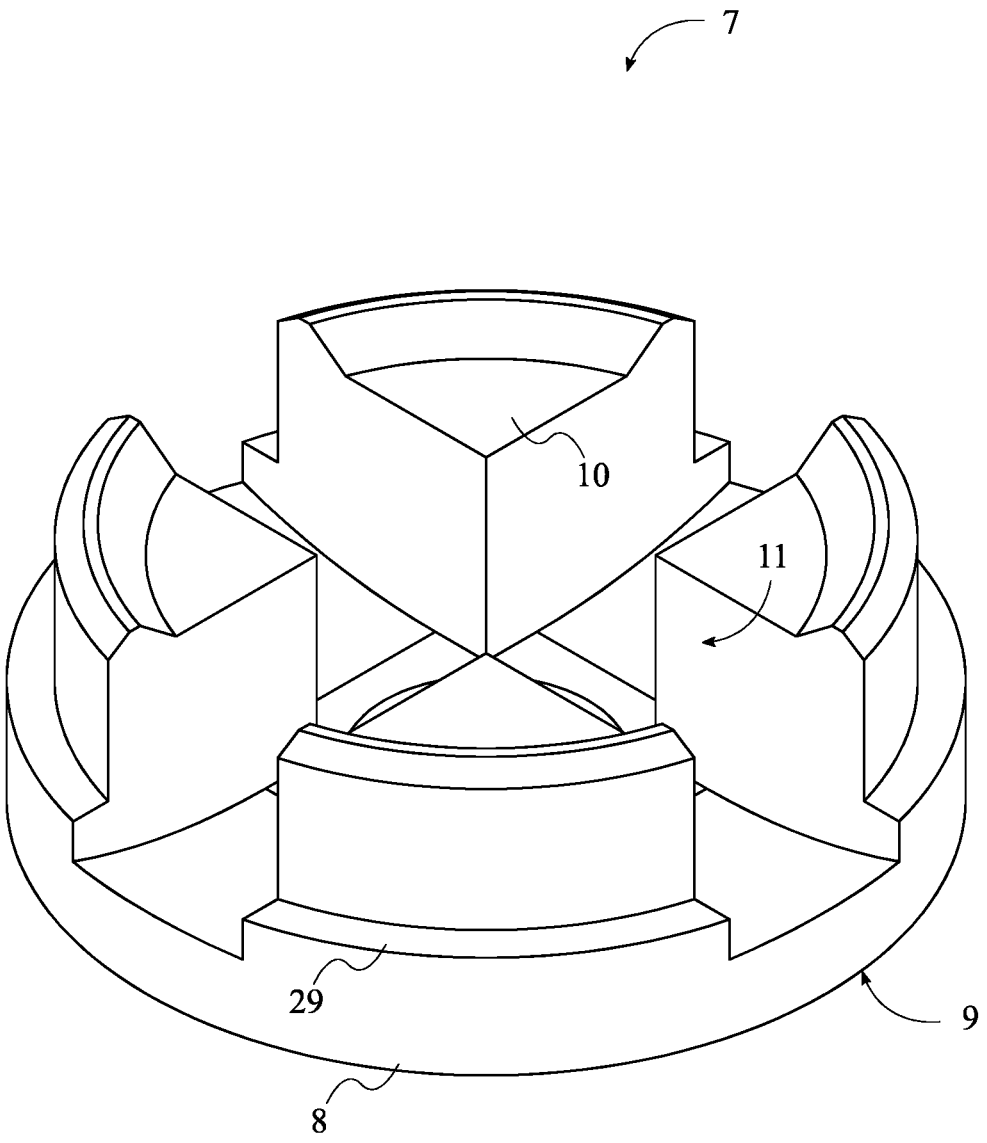
FIG. 9 is a top front perspective view showing the fluid diffuser.
Figure 10:
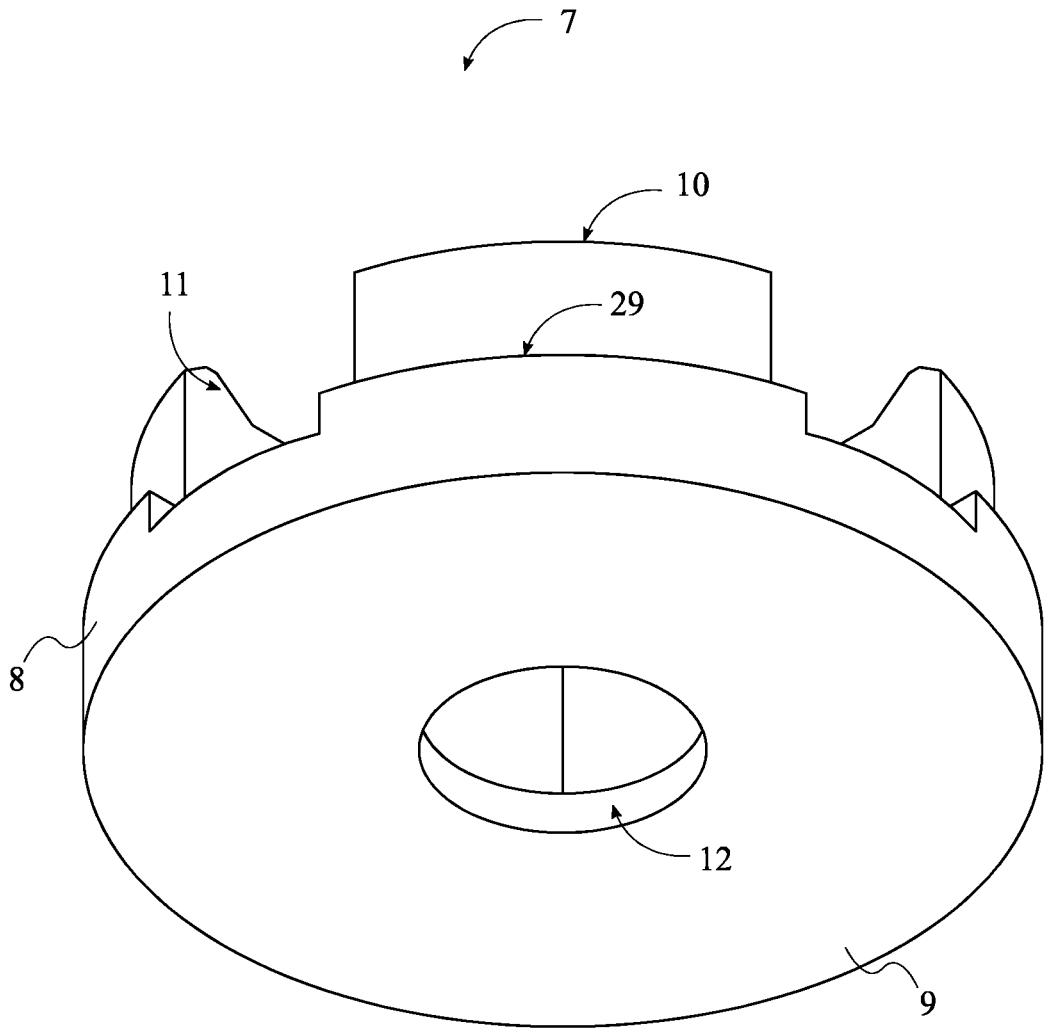
FIG. 10 is a bottom rear perspective view showing the fluid diffuser.
Figure 11:
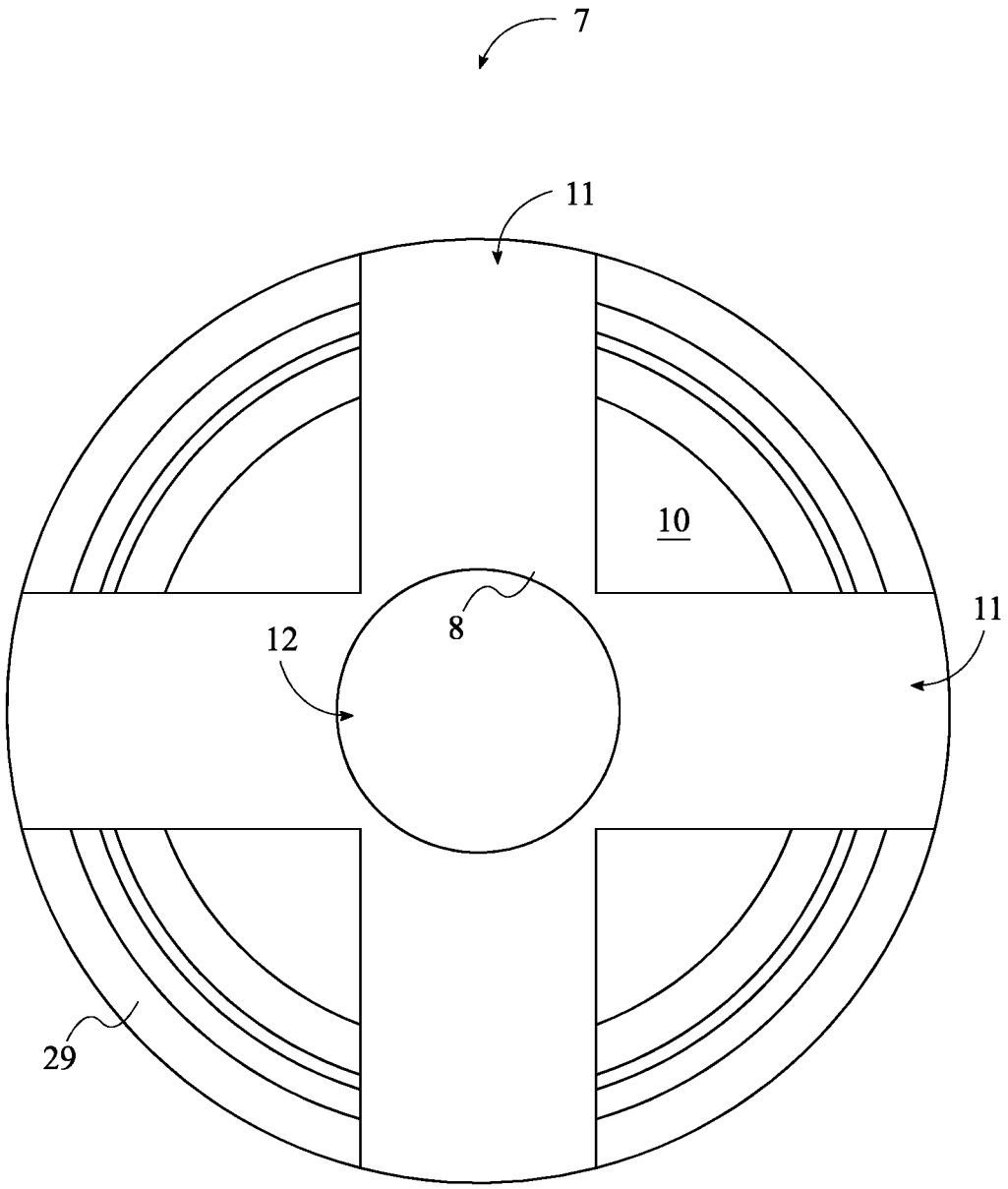
FIG. 11 is a top view showing the fluid diffuser.

To increase the efficiency of the fluid diffuser 7, the fluid diffuser 7 is designed to greatly increase the pressure of the flowing fluid. As can be seen in FIG. 9 through 11, the fluid diffuser 7 may comprise a diffuser body 8, one or more diffuser channels 11, and a fluid-receiving hole 12. In addition, the diffuser body 8 comprises a first diffuser face 9 and a second diffuser face 10. The first diffuser face 9 and the second diffuser face 10 are positioned opposite to each other about the diffuser body 8 to form the disc shape of the diffuser body 8. The fluid-receiving hole 12 axially traverses from the first diffuser face 9, through the diffuser body 8, and to the second diffuser face 10 to guide the fluid flow through the diffuser body 8. The one or more diffuser channels 11 traverse from the second diffuser face 10 into the diffuser body 8 to guide the fluid flow towards the fluid densifier 13. In addition, the one or more diffuser channels 11 are radially positioned about the fluid-receiving hole 12 to match the arrangement of the plurality of densifier inlets 17. The one or more diffuser channels 11 reduce in size outwardly to constantly build up pressure. As can be seen in FIG. 9, the cross-sectional area of the one or more diffuser channels 11 contracts along the length, with the cross-sectional area being the largest close to the fluid-receiving hole 12 and the smallest close to the periphery of the diffuser body 8. Further, the housing inlet 2 is in fluid communication with the fluid-receiving hole 12. Also, the fluid-receiving hole 12 is in fluid communication with the one or more diffuser channels 11. Thus, the fluid inflow is guided towards the one or more diffuser channels 11. Finally, each of the one or more diffuser channels 11 is in fluid communication with the plurality of densifier inlets 17 so the expanded fluid flows into the fluid densifier 13.

In addition, to keep the fluid flowing through the present invention without sloshing, the fluid diffuser 7 may further comprise an annular channel 29. As can be seen in FIGS. 5, 9, and 11, the annular channel 29 traverses from the second diffuser face 10 into the diffuser body 8 so that the annular channel 29 is part of the diffuser body 8 without interrupting the rotation of the diffuser body 8. The annular channel 29 is concentrically positioned around the fluid-receiving hole 12 and the annular channel 29 is peripherally positioned on the second diffuser face 10. Further, the annular channel 29 is intersected by each of the one or more diffuser channels 11. Thus, as can be seen in FIG. 5, as the diffuser body 8 keeps rotating, the expanded fluid keeps flowing from the one or more diffuser channels 11 into the plurality of densifier inlets 17.

To maintain the convergent housing 1 fully sealed to prevent fluid sloshing, the convergent housing 1 is designed to snug fit around the fluid diffuser 7 and the fluid densifier 13 without rotating the fluid densifier 13. As can be seen in FIG. 1 through 4, the convergent housing 1 may further comprise a first housing section 4 and a second housing section 5 to accommodate the fluid diffuser 7 and the fluid densifier 13 individually. The housing inlet 2 is integrated into the first housing section 4, while the housing outlet 3 is integrated into the second housing section 5. The first housing section 4 and the second housing section 5 are positioned opposite to each other about the convergent housing 1 to coincide with the fluid diffuser 7 and the fluid densifier 13. Thus, the fluid diffuser 7 is positioned within the first housing section 4 while the fluid densifier 13 is positioned within the second housing section 5.

To further prevent the loss of energy, the second housing section 5 may comprise a conical interior surface 30. As can be seen in FIGS. 4 and 5, the conical interior surface 30 comprises a narrow portion 31 and a wider portion 32 to form the conical shape. The narrow portion 31 is positioned adjacent to the housing outlet 3, while the wide portion 32 is positioned adjacent to the fluid diffuser 7 to accommodate the diffuser body 8. In addition, the densifier body 14 tapers from the first densifier face 15 to the second densifier face 16 so that the densifier body 14 fits within the second housing section 5. Thus, the conical interior surface 30 is positioned coextensive to the densifier body 14. When the fluid leaves the densifier outlet 18, the fluid enters the smooth open second housing section 5 with no traction, no vanes, and no captive sections. Thus, the fluid slips through and is directed back to the center of the second housing section 5, eliminating any centrifugal force to be reapplied to the flowing fluid. In other embodiments, the second housing section 5 may comprise non-conical interior surfaces matching different shapes of the densifier body 14.

Figure 17:
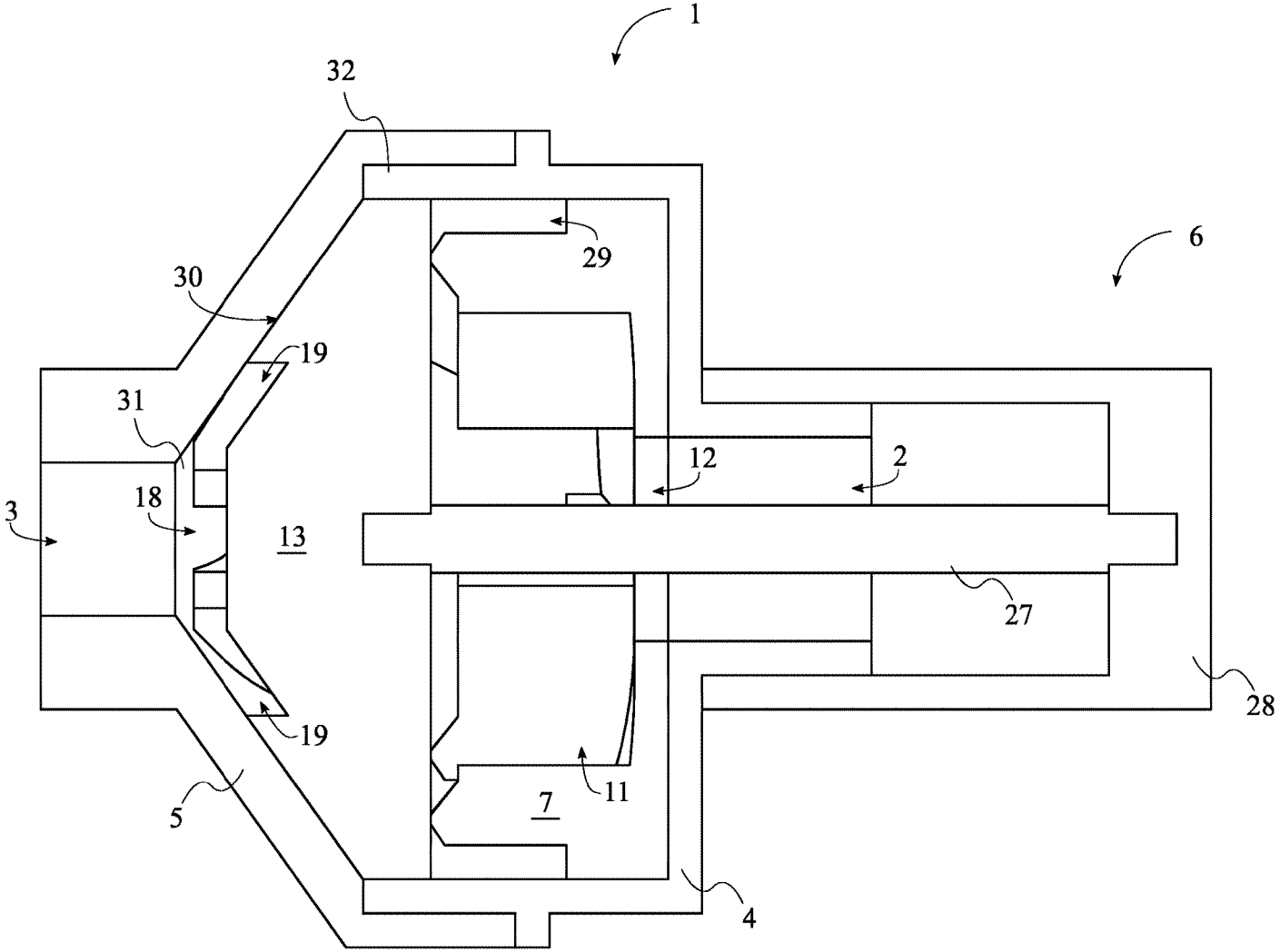
FIG. 17 is a schematic view showing the energy-conserving fluid pump with a strut assembly.

Finally, to maintain the fluid densifier 13 stationary within the convergent housing 1, the present invention may comprise a strut assembly 6. As can be seen in FIG. 17, the strut assembly 6 is positioned through the housing inlet 2, into the convergent housing 1, through the fluid-receiving hole 12 of the fluid diffuser 7, and to the first densifier face 15 to not obstruct with the rotation of the fluid diffuser 7. The fluid densifier 13 is terminally connected to the strut assembly 6 so that the strut assembly 6 supports the fluid densifier 13. Further, the strut assembly 6 is positioned normal to the first densifier face 15 and the strut assembly 6 is also axially positioned on the first densifier face 15 so that the convergent housing 1 may rotate while keeping the fluid densifier 13 stationary. With the primary system load being applied on the fluid densifier 13 and absorbed by the strut assembly 6, not by the rotating components, the present invention is able to maintain energy conservation on the flowing fluid. In some embodiments, the strut assembly 6 may comprise a torsion strut 27 and a strut shaft support 28. The strut shaft support 28 is positioned about the housing inlet 2. The strut shaft support 28 is also rotatably and externally connected to the convergent housing 1 so the convergent housing 1 can rotate independent of the strut shaft support 28. The torsion strut 27 is connected in between the first densifier face 15 and the strut shaft support 28 to keep the densifier body 14 stationary by resisting any load on the densifier body 14 that may cause torsion or translation of the densifier body 14 within the convergent housing 1. In other embodiments, the present invention may utilize different mechanisms to keep the fluid densifier 13 stationary within the convergent housing 1.

Although the invention has been explained in relation to its preferred embodiment, it is to be understood that many other possible modifications and variations can be made without departing from the spirit and scope of the invention as hereinafter claimed.

What is claimed is:

1. An energy-conserving fluid pump comprising:

a fluid diffuser;

a fluid densifier;

a convergent housing;

the fluid densifier comprising a densifier body, a plurality of densifier inlets, a densifier outlet, and a plurality of spiraling channels;

the densifier body comprising a first densifier face and a second densifier face;

the convergent housing comprising a housing inlet and a housing outlet;

the fluid diffuser and the fluid densifier being mounted to each other;

the fluid diffuser and the fluid densifier being positioned within the convergent housing;

the first densifier face and the second densifier face being positioned opposite to each other about the densifier body;

the plurality of densifier inlets traversing from the first densifier face, through the densifier body, and to the second densifier face;

the plurality of densifier inlets being peripherally distributed about the densifier body;

the densifier outlet and each of the plurality of spiraling channels traversing from the second densifier face into the densifier body;

the plurality of spiraling channels being radially positioned about densifier outlet;

the housing inlet being in fluid communication with the plurality of densifier inlets through the fluid diffuser;

each of the plurality of densifier inlets being in fluid communication with the densifier outlet through a corresponding spiraling channel from the plurality of spiraling channels; and, the densifier outlet being in fluid communication with the housing outlet.

2. The energy conservation pump as claimed in claim 1 comprising:

a magnetic coupling;

the magnetic coupling comprising a coupling rotor and a coupling stator;

the fluid diffuser being rotatably mounted within the convergent housing;

the fluid densifier being stationarily mounted within the convergent housing;

the fluid diffuser being the coupling rotor;

the coupling stator being externally mounted onto the convergent housing;

the coupling stator being positioned about the fluid diffuser; and, the coupling stator being operatively coupled to the coupling rotor, wherein the coupling stator is used to magnetically rotate the coupling rotor.

3. The energy-conserving fluid pump as claimed in claim 1 comprising:

a pump drive coupling;

the fluid diffuser being stationarily mounted within the convergent housing;

the fluid densifier being rotatably mounted within the convergent housing;

the pump drive coupling being positioned about the housing outlet; and, the pump drive coupling being torsionally and externally connected to the convergent housing.

4. The energy-conserving fluid pump as claimed in claim 1 comprising:

an electric motor;

the electric motor comprising a motor rotor and a motor stator;

the fluid diffuser being rotatably mounted within the convergent housing;

the fluid densifier being stationarily mounted within the convergent housing;

the electric motor being positioned within the convergent housing;

the motor stator being stationarily connected to the convergent housing; and, the motor rotor being torsionally connected to the fluid diffuser.

5. The energy-conserving fluid pump as claimed in claim 1 comprising:

the fluid diffuser comprising a diffuser body, one or more diffuser channels, and a fluid-receiving hole;

the diffuser body comprising a first diffuser face and a second diffuser face;

the first diffuser face and the second diffuser face being positioned opposite to each other about the diffuser body;

the fluid-receiving hole axially traversing from the first diffuser face, through the diffuser body, and to the second diffuser face;

the one or more diffuser channels traversing from the second diffuser face into the diffuser body;

the one or more diffuser channels being radially positioned about the fluid-receiving hole;

the housing inlet being in fluid communication with the fluid-receiving hole;

the fluid-receiving hole being in fluid communication with the one or more diffuser channels; and, each of the one or more diffuser channels being in fluid communication with the plurality of densifier inlets.

6. The energy-conserving fluid pump as claimed in claim 5 comprising:

the fluid diffuser further comprising an annular channel;

the annular channel traversing from the second diffuser face into the diffuser body;

the annular channel being concentrically positioned around the fluid-receiving hole;

the annular channel being peripherally positioned on the second diffuser face;

and, the annular channel being intersected by each of the one or more diffuser channels.

7. The energy-conserving fluid pump as claimed in claim 1 comprising:

the convergent housing further comprising a first housing section and a second housing section;

the housing inlet being integrated into the first housing section;

the housing outlet being integrated into the second housing section;

the first housing section and the second housing section being positioned opposite to each other about the convergent housing;

the fluid diffuser being positioned within the first housing section; and, the fluid densifier being positioned within the second housing section.

8. The energy-conserving fluid pump as claimed in claim 7 comprising:

the second housing section comprising a conical interior surface;

the conical interior surface comprising a narrow portion and a wider portion;

the narrow portion being positioned adjacent to the housing outlet;

the wide portion being positioned adjacent to the fluid diffuser;

the densifier body tapering from the first densifier face to the second densifier face; and, the conical interior surface being positioned coextensive to the densifier body.

9. The energy-conserving fluid pump as claimed in claim 1 comprising:

a strut assembly;

the strut assembly being positioned through the housing inlet, into the convergent housing, through a fluid-receiving hole of the fluid diffuser, and to the first densifier face;

the fluid densifier being terminally connected to the strut assembly;

the strut assembly being positioned normal to the first densifier face; and, the strut assembly being axially positioned on the first densifier face.

10. An energy-conserving fluid pump comprising:

a fluid diffuser;

a fluid densifier;

a convergent housing;

a strut assembly;

the fluid densifier comprising a densifier body, a plurality of densifier inlets, a densifier outlet, and a plurality of spiraling channels;

the densifier body comprising a first densifier face and a second densifier face;

the convergent housing comprising a housing inlet and a housing outlet;

the fluid diffuser and the fluid densifier being mounted to each other;

the fluid diffuser and the fluid densifier being positioned within the convergent housing;

the first densifier face and the second densifier face being positioned opposite to each other about the densifier body;

the plurality of densifier inlets traversing from the first densifier face, through the densifier body, and to the second densifier face;

the plurality of densifier inlets being peripherally distributed about the densifier body;

the densifier outlet and each of the plurality of spiraling channels traversing from the second densifier face into the densifier body;

the plurality of spiraling channels being radially positioned about densifier outlet;

the housing inlet being in fluid communication with the plurality of densifier inlets through the fluid diffuser;

each of the plurality of densifier inlets being in fluid communication with the densifier outlet through a corresponding spiraling channel from the plurality of spiraling channels;

the densifier outlet being in fluid communication with the housing outlet;

the strut assembly being positioned through the housing inlet, into the convergent housing, through a fluid-receiving hole of the fluid diffuser, and to the first densifier face;

the fluid densifier being terminally connected to the strut assembly;

the strut assembly being positioned normal to the first densifier face;

the strut assembly being axially positioned on the first densifier face; and the fluid diffuser comprising a diffuser body, one or more diffuser channels, fluid-receiving hole, and an annular channel.

11. The energy-conserving fluid pump as claimed in claim 10 comprising:

the diffuser body comprising a first diffuser face and a second diffuser face;

the first diffuser face and the second diffuser face being positioned opposite to each other about the diffuser body;

the fluid-receiving hole axially traversing from the first diffuser face, through the diffuser body, and to the second diffuser face;

the one or more diffuser channels traversing from the second diffuser face into the diffuser body;

the one or more diffuser channels being radially positioned about the fluid-receiving hole;

the housing inlet being in fluid communication with the fluid-receiving hole;

the fluid-receiving hole being in fluid communication with the one or more diffuser channels;

each of the one or more diffuser channels being in fluid communication with the plurality of densifier inlets;

the annular channel traversing from the second diffuser face into the diffuser body;

the annular channel being concentrically positioned around the fluid-receiving hole;

the annular channel being peripherally positioned on the second diffuser face; and, the annular channel being intersected by each of the one or more diffuser channels.

12. The energy-conserving fluid pump as claimed in claim 10 comprising:

the convergent housing further comprising a first housing section and a second housing section;

the second housing section comprising a conical interior surface;

the conical interior surface comprising a narrow portion and a wider portion;

the housing inlet being integrated into the first housing section;

the housing outlet being integrated into the second housing section;

the first housing section and the second housing section being positioned opposite to each other about the convergent housing;

the fluid diffuser being positioned within the first housing section;

the fluid densifier being positioned within the second housing section;

the narrow portion being positioned adjacent to the housing outlet;

the wide portion being positioned adjacent to the fluid diffuser;

the densifier body tapering from the first densifier face to the second densifier face; and, the conical interior surface being positioned coextensive to the densifier body.

* * * * *